United States Patent [19]

Steffanoff

[11] Patent Number: 4,832,368

[45] Date of Patent: May 23, 1989

[54] SURVIVAL INFORMATION SKI POLE

[76] Inventor: Nick Steffanoff, P.O. Box 40144, Portland, Oreg. 97240

[21] Appl. No.: 104,935

[22] Filed: Oct. 6, 1987

[51] Int. Cl.[4] ..... A63C 11/22

[52] U.S. Cl. ..... 280/821; 280/819; 135/66; 368/11

[58] Field of Search ..... 280/816, 819, 820, 821, 280/822; 368/11; 135/65, 66, 76

[56] References Cited

U.S. PATENT DOCUMENTS

| | | | |
|---|---|---|---|
| 4,082,302 | 4/1978 | Albrecht | 280/816 |
| 4,111,444 | 9/1978 | Clements, Jr. | 280/816 |
| 4,236,236 | 11/1980 | Jaunin | 368/11 |
| 4,244,220 | 1/1981 | Henson et al. | 280/819 |

FOREIGN PATENT DOCUMENTS

| | | | |
|---|---|---|---|
| 0180027 | 3/1954 | Austria | 280/816 |
| 2638671 | 3/1978 | Fed. Rep. of Germany | 280/816 |
| 2494999 | 6/1982 | France | 280/819 |

*Primary Examiner*—David M. Mitchell
*Assistant Examiner*—Brian L. Johnson
*Attorney, Agent, or Firm*—Leon Gilden

[57] ABSTRACT

A ski pole presenting survival information is set forth and particularly a replacement ski pole handle in combination with a ski pole is disclosed wherein said handle provides a digital readout of both current time and ambient temperature.

4 Claims, 1 Drawing Sheet

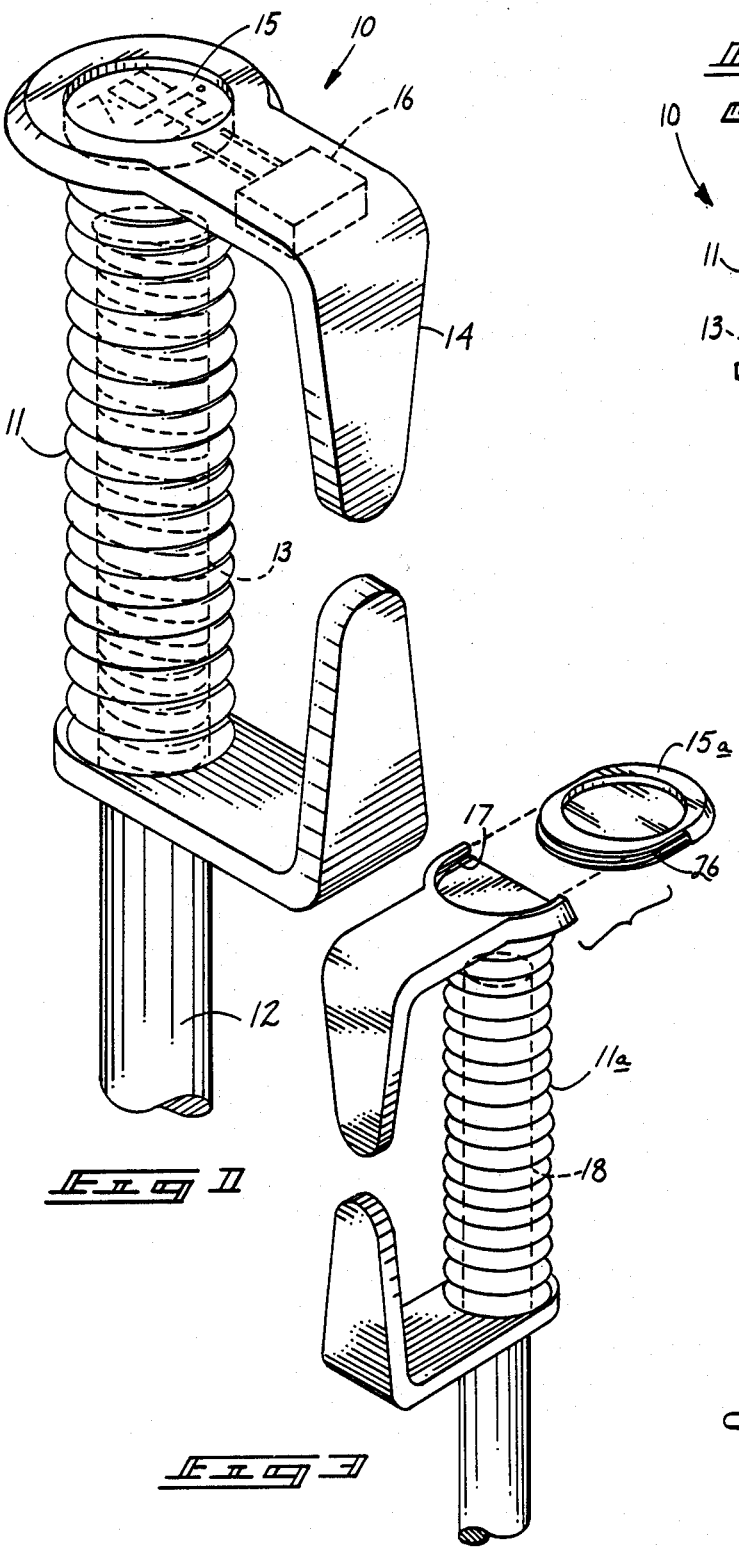
FIG 1
FIG 3
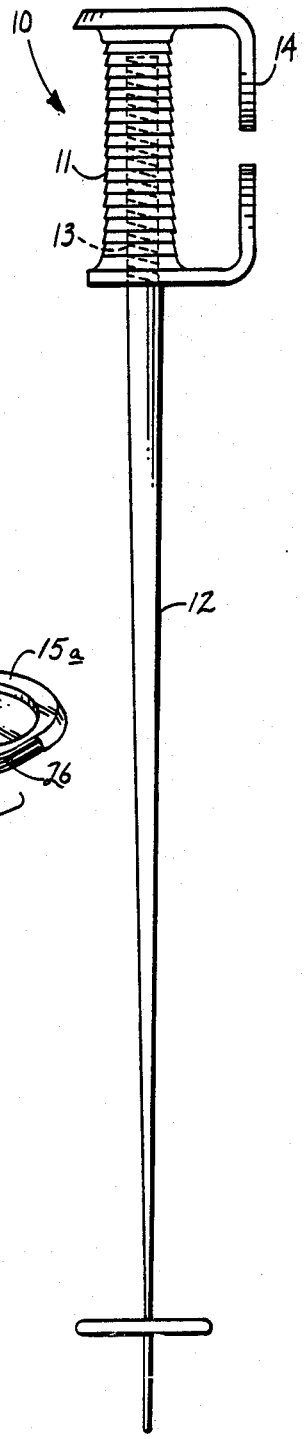
FIG 2

SURVIVAL INFORMATION SKI POLE

BACKGROUND OF THE INVENTION

1. Field of the Invention

The present invention relates to ski poles and more particularly to a new and improved ski pole handle wherein combination with a ski pole to present visual display of current time and temperature enabling a user to prevent unnecessary exposure to adverse climactic conditions.

2. Description of the Prior Art

The use of ski poles and the like is well known in the prior art. As may be appreciated, these devices have in the past been of conventional, utilitarian structure whereby as such its utility was limited to that of a balancing aid in skiing. Ski pole development has continued and in this connection, there have been several attempts to develop ski poles to expanded utility. For example, U.S. Pat. No. 3,596,921 to Bruckl has set forth the teaching of utilizing a ski pole of varying cross-sectional shapes for improvement in its strength thereby.

U.S. Pat. 3,730,544 to Hyman sets forth a breakdown ski pole with an interconnected cord including a tension release enabling the various sections to be disconnected from one another for ease of transport and to be re-connected at a later time and location for continued use.

U.S. Pat. No. 4,062,554 to Korger has set forth a ski pole with an extended handle providing an impact surface for use as a buffer upon impact to protect a skier thereby.

U.S. Pat. No. 4,206,445 to Steinhauer has developed an improved handle for a ski pole with an optionally utilizable visible warning light for use by a skier. The light in this instance is for indicating on a crowded slope an intended direction, be it right or left, by a user of the invention enabling a following skier to maneuver in a safe manner relative thereto.

U.S. Pat. No. 4,214,770 to Agins discloses the use of a ski pole with a novel handle enabling securement of an umbrella-type structure therein for use as a windshield or sunshield, as circumstances may dictate, to provide a skier with some protection from discomfort utilizing the invention.

U.S. Pat. No. 4,229,015 to Ramsey uses a hollow handle ski pole with a removable plug therein to contain a liquid for ultimate consumption by a user.

U.S. Pat. No. 4,244,220 to Henson sets forth a snap-fit analogue temperature readout formed with a co-extending temperature sensor remotely positioned in an adjoining ski pole shaft. The complexity and sensitivity of such a device and further not providing attendant time information renders a user vulnerable to hazardous climactic situations due to insufficient information including a rather coplex structure prone to malfunction.

It may be appreciated that the varying improvements in ski handles in combination with ski poles have developed into a means of aiding in the relief of a user but as such have not provided a means for yielding information necessary for enjoyment of a ski situation and further provide life saving information as to the imminency of nightfall relative to a sudden drop in temperature. The relative proximity of nightfall and the noraml drop in temperature associated therewith necessitates knowledge of current time necessary in evaluating temperature variations. This total package of information is constantly displayed by my invention.

SUMMARY OF THE INVENTION

In view of the foregoing disadvantages inherent in the known types of ski poles now present in the prior art, the present invention provides an an improved ski pole provided with a time and temperature LCD (liquid crystal diode) display that may be easily viewed and understood. As such, the general purpose of the present invention, which will be described subsequently in greater detail, is to provide a new and improved ski pole which has all the advantages of the prior art ski poles and none of the disadvantages.

To attain this, the present invention comprises a ski pole including a ski pole handle with time and temperature in LCD form positioned in a sheltered recessed portion of the handle to provide for a relatively long and dependable lifecycle of the device. The invention is further so oriented and arranged for quick and convenient understanding of such information by a user. The handle itself may be adapted to pre-existing ski poles through a threaded or standard slip-on connection or formed of unitary construction in with a ski pole.

It is understood that during the course of the recreational sport of skiing, that certain paths and ski trails may lead an individual to remote areas removed from access to normal information. Even should a skier be equipped with a watch, it is normally under several layers of ski clothing and not of ready access or use. With my invention, a user may be apprised of current time and temperature where both elements of information may be necessary to remove an individual from a dangerous situation when climactic variations in temperature could prove to be dangerous. Furthermore, variations in temperature and variations in temperature as related to the time of day may dramatically vary the quality of skiing conditions and related ski functions.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from the cursory inspection the nature and essence of the technical disclosure of the application. The abstract is neither intended to define the invention of the application, which is measured by the claims, nor is it intended to be limiting as to the scope of the invention is any way.

It is therefore an object of the present invention to provide a new and improved ski pole which has all the advantages of the prior art ski poles and none of the disadvantages.

It is another object of the present invention to provide a new and improved ski pole which may be easily and efficiently manufactured and marketed.

It is a further object of the present invention to provide a new and improved ski pole which is of a durable and reliable construction.

An even further object of the present invention is to provide a new and improved ski pole which is susceptible to a low cost of manufacture with regard to both materials and labor, and which accordingly is then susceptible to low prices of sale to the consuming public, thereby making such ski poles economically available to the buying public.

Still yet another object of the present invention is to provide a new and improved ski pole handle which provides in the apparatuses and methods of the prior art some of the advantages thereof, while simultaneously overcoming some of the disadvantages normally associated therewith.

Still another object of the present invention is to provide a new and improved ski pole handle wherein a liquid crystal diode readout of current time and temperature is presented in a recessed position within the handle.

Yet another object of the present invention is to provide a new and improved ski pole handle wherein a handle portion of a ski pole is removably and threadedly or conventionally mounted for slip-on use with varying ski pole shafts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric view of the invention illustrating the LCD (liquid crystal diode) information assembly in a recessed positioned within the ski pole handle.

FIG. 2 is an orthographic side view of the ski pole including the improved handle secured thereto.

FIG. 3 is an isometric view of a modification of the invention illustrating the LCD (liquid crystal diode) information assembly replaceably positioned within the ski pole handle.

DESCRIPTION OF THE PREFERRED EMBODIMENT

With reference now to the drawings, and in particular to FIG. 1 thereof, a new and improved ski pole embodying the principles and concepts of the present invention and generally designated by the reference numeral 10 will be described.

More specifically there is disclosed a ski pole formed with a handle 11 secured on shaft 12 by conventional fastening means, such as a threaded interconnection 13. It is to be understood that various connection techniques may be utilized involving the use of set screws adhesives, or conventional slip-on or friction fit, etc., all within the purview of one skilled in the art. For convenience and enhanced gripping of handle 11, an integral guard 14 is formed of a split construction, as illustrated. The use of a guard assists in the gripping by tending to minimize unintentional dropping or repositioning of the pole by a user. The LCD (liquid crystal diode) display module 15 is positioned in a recessed manner relative to upper guard 14 with an included replaceable battery source indicated at 16 conveniently positioned within upper guard 14. Alternatively, the battery source may be integrally formed within module 15.

Recessed positioning of module 15 within handle 11 presents a reduced exposure to damage of module 15 to insure continuous communication of the time and temperature information to a user of my invention.

FIG. 3 illustrates a modification of the instant invention wherein a display module 15 has formed thereto an integral rib 26 formed to be presented in a frictional secured interfitting relationship with a groove 17 formed in a recessed "U" shaped opening within handle **11*a*. In this mode the module 15*a* may be replaced by successive modules as necessary enabling improved modules to be inserted therein. Of further note in FIG. 3 is the conventional "slip-on" handle configuration as a blind bore in handle 11*a* accepts a shaft 18** of a ski pole for a friction fit interconnection.

It is to be understood that the combination of time and temperature information is crucial to continuous and uninterrupted enjoyment of a recreational facility when skiing and should the time and temperature relationship indicate a warning or hazardous impending situation, such as a significant temperature drop in a short period of time somewhat late in the evening for example, a user would be apprised of the situation immediately and accordingly seek shelter.

As to the manner of usage and operation of the present invention, the same should be apparent from the above description. Accordingly therefore, the discussion relative the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A new and improved ski pole handle for use in combination with a ski shaft comprising:

an elongate ski pole handle formed with a first end for attachment to a ski pole shaft and a second end formed with a recess shaft and a second end formed with a recess therein, and a time and temperature replaceable self-contained module of a liquid crystal diode type selectively positionable within said recess at said second end, and said recess defining a "U" shaped recess means therein for acceptance of the replaceable self-contained module, and said module is formed with a "U" shaped integral extending rib for interfitting within a complementary "U" shaped groove formed within said "U" shaped recess means, said "U" shaped recess means orthogonally oriented relative to said elongate ski pole handle at an uppermost surface of said elongate ski pole handle remote from said ski pole.

2. A new and improved ski pole handle as set forth in claim 1 including a guard means formed of two-piece split construction forming a guard means spaced from said handle for enabling insertion of a user's hand between said handle and said guard means.

3. A new and improved ski pole handle as set forth in claim 1 wherein the attachment to said ski pole shaft is a threaded connection between said handle and said shaft wherein said handle is formed with a threaded blind bore accepting a correspondingly threaded ski pole shaft.

4. A new and improved ski pole handle as set forth in claim 1 wherein the attachment to said ski pole shaft is a friction fit connection between said handle and said shaft wherein said handle is formed with a blind bore accepting a complementary configured ski pole shaft.

* * * * *